US011829084B2

(12) United States Patent
Peter et al.

(10) Patent No.: US 11,829,084 B2
(45) Date of Patent: Nov. 28, 2023

(54) REGISTRATION OF WHITE TONER IN AN ELECTROPHOTOGRAPHIC PRINTER

(71) Applicant: Eastman Kodak Company, Rochester, NY (US)

(72) Inventors: Karlheinz Peter, Molfsee (DE); Hans-Guenter Staack, Rochester, NY (US); Michael Thomas Dobbertin, Honeoye, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 17/952,392

(22) Filed: Sep. 26, 2022

(65) Prior Publication Data

US 2023/0100357 A1 Mar. 30, 2023

Related U.S. Application Data

(60) Provisional application No. 63/249,103, filed on Sep. 28, 2021.

(51) Int. Cl.
*G03G 15/01* (2006.01)

(52) U.S. Cl.
CPC ..... *G03G 15/0131* (2013.01); *G03G 15/0152* (2013.01); *G03G 2215/00042* (2013.01); *G03G 2215/0161* (2013.01)

(58) Field of Classification Search
CPC ..... G03G 15/0131; G03G 15/0152; G03G 2215/00042; G03G 2215/0161
See application file for complete search history.

(56) References Cited

U.S. PATENT DOCUMENTS 5,523,823 A * 6/1996 Ashikaga ..... H04N 1/506 347/116
6,421,522 B2 7/2002 Henderson et al.
6,480,693 B2 11/2002 Liston et al.
6,493,012 B2 12/2002 Buch et al.
6,496,678 B2 12/2002 Metzler et al.
6,519,423 B2 2/2003 Dreher et al.
6,522,857 B2 2/2003 Dreher et al.
6,532,873 B2 3/2003 Hunold et al.
(Continued)

FOREIGN PATENT DOCUMENTS

JP H05119572 A * 5/1993

*Primary Examiner* — Ryan D Walsh
(74) *Attorney, Agent, or Firm* — David A. Novais

(57) ABSTRACT

An electrophotographic printing system for printing with a set of toners including a white toner. A plurality of printing modules are configured to print respective toner patterns, each including a toner image printed onto a receiver medium being transported on a transparent transport web and a corresponding registration mark positioned outside a border of the receiver medium. A first registration mark sensing system is positioned to detect the registration marks printed with a first subset of the toners that doesn't include the white toner. A second registration mark sensing system is positioned to detect the registration marks printed with a second subset of the toners that includes the white toner. The registration mark sensing systems each include a reflector plate positioned behind the transport web. The reflector plate for the first registration mark sensing system is white, and the reflector plate for the second registration mark sensing system is black.

17 Claims, 12 Drawing Sheets

(56) References Cited

U.S. PATENT DOCUMENTS

| | | | | |
|---|---|---|---|---|
| 6,553,906 | B1 | 4/2003 | Bucks et al. | |
| 6,587,652 | B2 | 7/2003 | Metzler | |
| 6,591,747 | B2 | 7/2003 | Buch et al. | |
| 6,619,209 | B2 | 9/2003 | Dreher et al. | |
| 6,718,879 | B2 | 4/2004 | Dreher et al. | |
| 6,817,295 | B2 | 11/2004 | Metzler | |
| 6,836,635 | B2 | 12/2004 | Metzler et al. | |
| 6,848,361 | B2 | 2/2005 | Metzler | |
| 6,889,028 | B1 | 5/2005 | Hunold et al. | |
| 6,920,292 | B2 | 7/2005 | Metzler | |
| 6,925,278 | B2 | 8/2005 | Boness et al. | |
| 6,934,041 | B2 | 8/2005 | Liston et al. | |
| 7,035,557 | B2 | 4/2006 | Boness et al. | |
| 7,593,656 | B2 | 9/2009 | Boness et al. | |
| 8,301,048 | B1 | 10/2012 | Boness et al. | |
| 8,351,829 | B2 | 1/2013 | Boness et al. | |
| 8,405,879 | B2 | 3/2013 | Boness et al. | |
| 8,625,159 | B2 | 1/2014 | Boness et al. | |
| 9,545,796 | B1 | 1/2017 | Liston et al. | |
| 10,209,661 | B2 * | 2/2019 | Fukai | G03G 15/0189 |
| 2002/0136570 | A1 * | 9/2002 | Yamanaka | H04N 1/047 399/301 |
| 2010/0051165 | A1 * | 3/2010 | Tombs | H05K 3/1266 156/60 |
| 2012/0097872 | A1 * | 4/2012 | Ito | G03G 15/0189 250/559.4 |
| 2014/0050496 | A1 * | 2/2014 | Furuta | G01J 3/524 399/72 |
| 2018/0020108 | A1 * | 1/2018 | Nakayama | B65H 5/068 |

* cited by examiner

REGISTRATION OF WHITE TONER IN AN ELECTROPHOTOGRAPHIC PRINTER

CROSS-REFERENCE TO RELATED APPLICATIONS

This application claims the benefit of U.S. Provisional Patent Application No. 63/249,103, filed Sep. 28, 2021, which is incorporated herein by reference in its entirety.

Reference is made to commonly assigned, co-pending U.S. patent application Ser. No. 17/952,398 (now Publication No. US 2023/0098967) entitled: "Registration of white toner using sensing system with colored reflector plate", by C.-H. Kuo, which is incorporated herein by reference.

FIELD OF THE INVENTION

This invention pertains to the field of electrographic printing and more particularly to correcting registration errors in printing systems that utilize a white toner.

BACKGROUND OF THE INVENTION

Electrophotography is a useful process for printing images on a receiver (or "imaging substrate"), such as a piece or sheet of paper or another planar medium (e.g., glass, fabric, metal, or other objects) as will be described below. In this process, an electrostatic latent image is formed on a photoreceptor by uniformly charging the photoreceptor and then discharging selected areas of the uniform charge to yield an electrostatic charge pattern corresponding to the desired image (i.e., a "latent image").

After the latent image is formed, charged toner particles are brought into the vicinity of the photoreceptor and are attracted to the latent image to develop the latent image into a toner image. Note that the toner image may not be visible to the naked eye depending on the composition of the toner particles (e.g., clear toner).

After the latent image is developed into a toner image on the photoreceptor, a suitable receiver is brought into juxtaposition with the toner image. A suitable electric field is applied to transfer the toner particles of the toner image to the receiver to form the desired print image on the receiver. The imaging process is typically repeated many times with reusable photoreceptors.

The receiver is then removed from its operative association with the photoreceptor and subjected to heat or pressure to permanently fix (i.e., "fuse") the print image to the receiver. Plural print images (e.g., separation images of different colors) can be overlaid on the receiver before fusing to form a multi-color print image on the receiver.

When printing a plurality of color channels, one problem which can occur is registration errors where the printed color channels are offset from one another, either in the cross-track or in-track directions or both. These errors are typically addressed by printing registration marks which can be measured to characterize any offsets between the actual positions and the expected positions of the registration marks. The positions of subsequently printed images can then be adjusted in order to bring the color channels into alignment. This approach has been found to work well in conventional printing systems which use a set of colored toners (e.g., CMYK). However, some printing systems utilize inks with white toners, or toners with a very low colorant level. In such cases, conventional sensors that are used to measure the positions of the registration marks typically can't reliably detect the positions of the registration marks.

There remains a need for a registration system for an electrophotographic printer which can detect the position of registration marks printed with a white toner or toners with a very low colorant level.

SUMMARY OF THE INVENTION

The present invention represents an electrophotographic printing system for printing with a set of toners including a white toner, including:

a transport web that is at least partially transparent, wherein the transport web moves in an in-track direction;

a plurality of printing modules, each printing module configured to print a toner pattern using a respective toner from the set of toners onto a first surface of the transport web, wherein the toner pattern includes a toner image to be printed onto a receiver medium being transported on the first surface of the transport web and a corresponding registration mark positioned outside a border of the receiver medium;

a first registration mark sensing system positioned to detect the registration marks printed with a first subset of the toners that doesn't include the white toner, the first registration mark sensing system including:

- a first light source positioned over the first surface of the transport web;
- a first reflector plate positioned behind the transport web, wherein the first reflector plate has a color which is lighter than the toners in the first subset of toners; and
- a first light detector positioned over the first surface of the transport web;
- wherein the first light detector is positioned to detect light that is emitted by the first light source, transmitted through the transport web and reflected off the first reflector plate;

a second registration mark sensing system positioned to detect the registration marks printed with a second subset of the toners that includes the white toner, the second registration mark sensing system including:

- a second light source positioned over the first surface of the transport web;
- a second reflector plate positioned behind the transport web, wherein the second reflector plate has a color which is darker than the white toner; and
- a second light detector positioned over the first surface of the transport web;
- wherein the second light detector is positioned to detect light that is emitted by the second light source, transmitted through the transport web and reflected off the second reflector plate; and a registration correction system that analyzes signals from the first and second registration mark sensing systems to detect positions of the registration marks printed by each of the printing modules, determines corresponding registration errors, and adjusts the registration of subsequently printed toner patterns to compensate for the determined registration errors.

This invention has the advantage that registration characteristics for white toners and other weakly-pigmented toners can be accurately determined, even when it is the first toner that is printed.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

Figure 1:
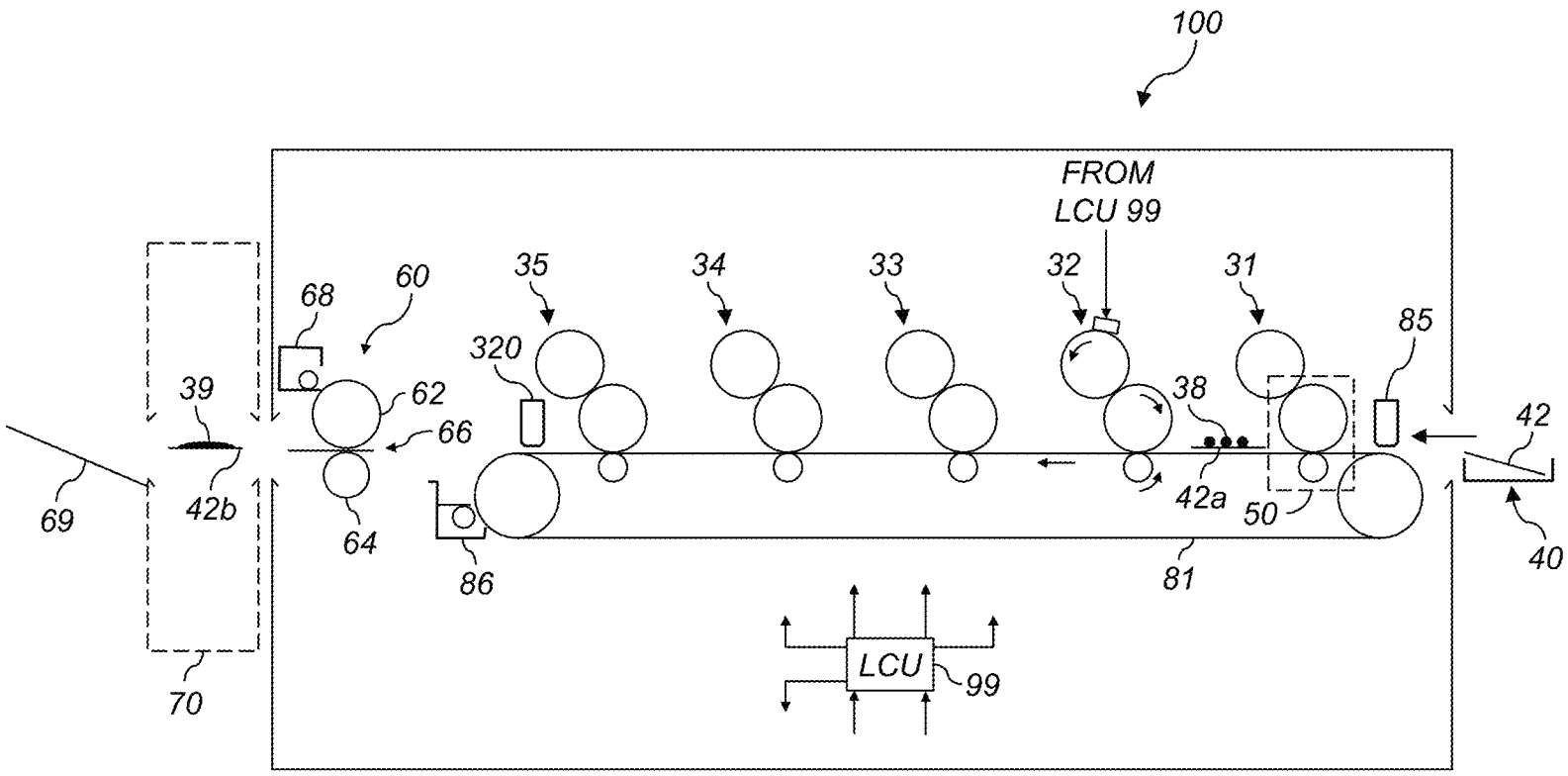
FIG. 1 (Prior Art)
FIG. 1 is an elevational cross-section of an electrophotographic printer suitable for use with various embodiments.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated, or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

As used herein, "sheet" is a discrete piece of media, such as receiver media for an electrophotographic printer (described below). Sheets have a length and a width. Sheets are folded along fold axes (e.g., positioned in the center of the sheet in the length dimension, and extending the full width of the sheet). The folded sheet contains two "leaves," each leaf being that portion of the sheet on one side of the fold axis. The two sides of each leaf are referred to as "pages." "Face" refers to one side of the sheet, whether before or after folding.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., precipitated from a solution of a pigment and a dispersant using an organic solvent), as is known in the art. Toner particles can have a range of diameters (e.g., less than 8 μm, on the order of 10-15 μm, up to approximately 30 μm, or larger), where "diameter" preferably refers to the volume-weighted median diameter, as determined by a device such as a Coulter Multisizer. When practicing this invention, it is preferable to use larger toner particles (i.e., those having diameters of at least 20 μm) in order to obtain the desirable toner stack heights that would enable macroscopic toner relief structures to be formed.

"Toner" refers to a material or mixture that contains toner particles, and that can be used to form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

As mentioned already, toner includes toner particles; it can also include other types of particles. The particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remanence, florescence, resistance to etchants, and other properties of additives known in the art.

In single-component or mono-component development systems, "developer" refers to toner alone. In these systems, none, some, or all of the particles in the toner can themselves be magnetic. However, developer in a mono-component system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles (e.g., 15-20 μm or 20-300 μm in diameter). A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields). The present invention can be practiced using any type of electrographic printing system, including electrophotographic and ionographic printers.

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color images onto a receiver. A printer can also produce selected patterns of toner on a receiver, which patterns (e.g., surface textures) do not correspond directly to a visible image.

The DFE receives input electronic files (such as Postscript command files) composed of images from other input devices (e.g., a scanner, a digital camera or a computer-generated image processor). Within the context of the present invention, images can include photographic renditions of scenes, as well as other types of visual content such as text or graphical elements. Images can also include invisible content such as specifications of texture, gloss or protective coating patterns.

The DFE can include various function processors, such as a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system that accounts for characteristics of the image printing process implemented in the print engine (e.g., the electrophotographic process) to provide known, consistent color reproduction characteristics. The color management system can also provide known color reproduction for different inputs (e.g., digital camera images or film images). Color management systems are well-known in the art, and any such system can be used to provide color corrections in accordance with the present invention.

In an embodiment of an electrophotographic modular printing machine useful with various embodiments (e.g., the NEXPRESS SX 3900 printer manufactured by Eastman Kodak Company of Rochester, NY) color-toner print images are made in a plurality of color imaging modules arranged in tandem, and the print images are successively electrostatically transferred to a receiver adhered to a transport web moving through the modules. Colored toners include colorants, (e.g., dyes or pigments) which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing features such as protecting the print from fingerprints, reducing certain visual artifacts or providing desired texture or surface finish characteristics. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
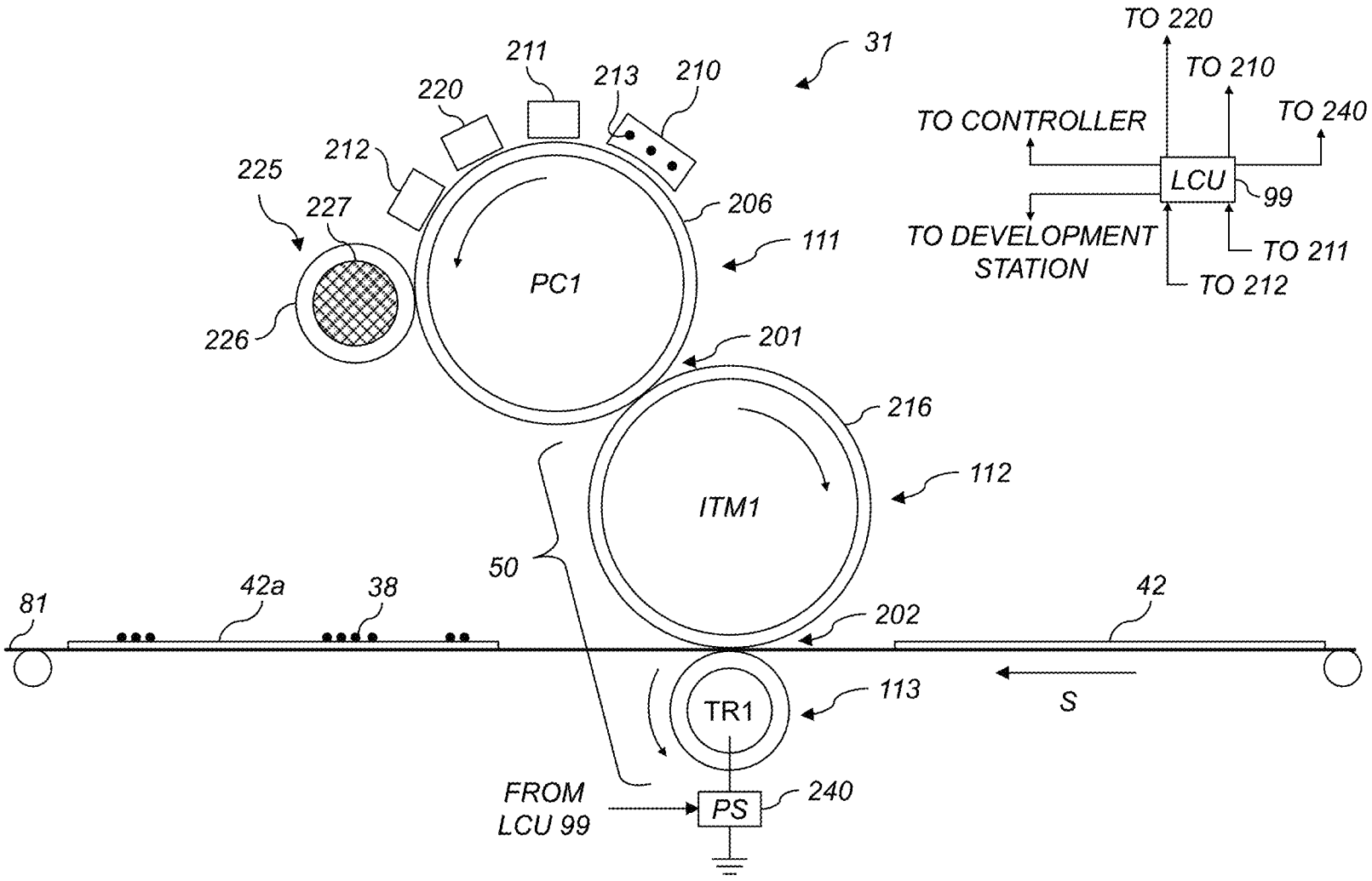
FIG. 2 (Prior Art)
FIG. 2 is an elevational cross-section of one printing module of the electrophotographic printer of FIG. 1.

FIGS. 1-2 are elevational cross-sections showing portions of a typical electrophotographic printer 100 useful with various embodiments. Printer 100 is adapted to produce images, such as single-color images (i.e., monochrome images), or multicolor images such as CMYK, or pentachrome (five-color) images, on a receiver. Multicolor images are also known as "multi-component" images. One embodiment involves printing using an electrophotographic print engine having five sets of single-color image-producing or image-printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver 42 successively moved through the modules. In some embodiments one or more of the printing module 31, 32, 33, 34, 35 can print a colorless toner image, which can be used to provide a protective overcoat or tactile image features. Receiver 42 is transported from supply unit 40, which can include active feeding subsystems as known in the art, into printer 100 using a transport web 81. In various embodiments, the visible image can be transferred directly from an imaging roller to a receiver, or from an imaging roller to one or more transfer roller(s) or belt(s) in sequence in transfer subsystem 50, and then to receiver 42. Receiver 42 is, for example, a selected section of a web or a cut sheet of a planar receiver media such as paper or transparency film.

In the illustrated embodiments, each receiver 42 can have up to five single-color toner images transferred in registration thereon during a single pass through the five printing modules 31, 32, 33, 34, 35 to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an exemplary embodiment, printing module 31 forms black (K) print images, printing module 32 forms yellow (Y) print images, printing module 33 forms magenta (M) print images, and printing module 34 forms cyan (C) print images.

Printing module 35 can form a red, blue, green, or other fifth print image, including an image formed from a clear toner (e.g., one lacking pigment). The four subtractive primary colors, cyan, magenta, yellow, and black, can be combined in various combinations of subsets thereof to form a representative spectrum of colors. The color gamut of a printer (i.e., the range of colors that can be produced by the printer) is dependent upon the materials used and the process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42*a* is shown after passing through printing module 31. Print image 38 on receiver 42*a* includes unfused toner particles. Subsequent to transfer of the respective print images, overlaid in registration, one from each of the respective printing modules 31, 32, 33, 34, 35, receiver 42*a* is advanced to a fuser module 60 (i.e., a fusing or fixing assembly) to fuse the print image 38 to the receiver 42*a*. Transport web 81 transports the print-image-carrying receivers to the fuser module 60, which fixes the toner particles to the respective receivers, generally by the application of heat and pressure. The receivers are serially de-tacked from the transport web 81 to permit them to feed cleanly into the fuser module 60. The transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along the transport web 81 before or after cleaning station 86 in the direction of rotation of transport web 81.

Sensors can be positioned within the printer 100 to sense various quantities that can be useful for various process control operations. FIG. 1 shows two such sensors, a leading edge sensor 85 which is used to sense the position of the leading edge of receiver 42*a* on the transport web 81. Registration mark sensing system 320 is used to sense the positions of registration marks that are printed onto the transport web 81 by the printing modules 31, 32, 33, 34, 35. The signals from these sensors can be used to control the timing of the signals used to write the toner images in order to properly align the printed image to the receiver 42*a* and to correct registration errors between the different color channels.

In the illustrated embodiment, the fuser module 60 includes a heated fusing roller 62 and an opposing pressure roller 64 that form a fusing nip 66 therebetween. In an embodiment, fuser module 60 also includes a release fluid application substation 68 that applies release fluid, e.g., silicone oil, to fusing roller 62. Alternatively, wax-containing toner can be used without applying release fluid to the fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The fused receivers (e.g., receiver 42*b* carrying fused image 39) are transported in series from the fuser module 60 along a path either to an output tray 69, or back to printing modules 31, 32, 33, 34, 35 to form an image on the backside of the receiver (i.e., to form a duplex print). Receivers 42*b* can also be transported to any suitable output accessory. For example, an auxiliary fuser or glossing assembly can provide a clear-toner overcoat. Printer 100 can also include multiple fuser modules 60 to support applications such as overprinting, as known in the art.

In various embodiments, between the fuser module 60 and the output tray 69, receiver 42*b* passes through a finisher 70. Finisher 70 performs various paper-handling operations, such as folding, stapling, saddle-stitching, collating, and binding.

Printer 100 includes main printer apparatus logic and control unit (LCU) 99, which receives input signals from various sensors associated with printer 100 and sends control signals to various components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. In some embodiments, sensors associated with the fuser module 60 provide appropriate signals to the LCU 99. In response to the sensor signals, the LCU 99 issues command and control signals that adjust the heat or pressure within fusing nip 66 and other operating parameters of fuser module 60. This permits printer 100 to print on receivers of various thicknesses and surface finishes, such as glossy or matte.

Image data for printing by printer 100 can be processed by a raster image processor (RIP; not shown), which can include a color separation screen generator or generators. The output of the RIP can be stored in frame or line buffers for transmission of the color separation print data to each of a set of respective LED writers associated with the printing modules 31, 32, 33, 34, 35 (e.g., for black (K), yellow (Y), magenta (M), cyan (C), and red (R) color channels, respectively). The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes (e.g., color correction) in order to obtain the desired color print. Color image data is separated into the respective colors and converted by the RIP to halftone dot image data in the respective color (for example, using halftone matrices, which provide desired screen angles and screen rulings). The RIP can be a suitablyprogrammed computer or logic device and is adapted to employ stored or computed halftone matrices and templates for processing separated color image data into rendered image data in the form of halftone information suitable for printing. These halftone matrices can be stored in a screen pattern memory.

FIG. 2 shows additional details of printing module 31, which is representative of printing modules 32, 33, 34, and 35 (FIG. 1). Photoreceptor 206 of imaging member 111 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors 206 can also contain multiple layers.

Charging subsystem 210 applies a uniform electrostatic charge to photoreceptor 206 of imaging member 111. In an exemplary embodiment, charging subsystem 210 includes a wire grid 213 having a selected voltage. Additional necessary components provided for control can be assembled about the various process elements of the respective printing modules. Meter 211 measures the uniform electrostatic charge provided by charging subsystem 210.

An exposure subsystem 220 is provided for selectively modulating the uniform electrostatic charge on photoreceptor 206 in an image-wise fashion by exposing photoreceptor 206 to electromagnetic radiation to form a latent electrostatic image. The uniformly-charged photoreceptor 206 is typically exposed to actinic radiation provided by selectively activating particular light sources in an LED array or a laser device outputting light directed onto photoreceptor 206. In embodiments using laser devices, a rotating polygon (not shown) is sometimes used to scan one or more laser beam(s) across the photoreceptor in the fast-scan direction. One pixel site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each pixel site in the row during that line exposure time.

As used herein, an "engine pixel" is the smallest addressable unit on photoreceptor 206 which the exposure subsystem 220 (e.g., the laser or the LED) can expose with a selected exposure different from the exposure of another engine pixel. Engine pixels can overlap (e.g., to increase addressability in the slow-scan direction). Each engine pixel has a corresponding engine pixel location, and the exposure applied to the engine pixel location is described by an engine pixel level.

The exposure subsystem 220 can be a write-white or write-black system. In a write-white or "charged-area-development" system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or "discharged-area development" system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

In the illustrated embodiment, meter 212 is provided to measure the post-exposure surface potential within a patch area of a latent image formed from time to time in a non-image area on photoreceptor 206. Other meters and components can also be included (not shown).

A development station 225 includes toning shell 226, which can be rotating or stationary, for applying toner of a selected color to the latent image on photoreceptor 206 to produce a developed image on photoreceptor 206 corresponding to the color of toner deposited at this printing module 31. Development station 225 is electrically biased by a suitable respective voltage to develop the respective latent image, which voltage can be supplied by a power supply (not shown). Developer is provided to toning shell 226 by a supply system (not shown) such as a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In some embodiments, the development station 225 employs a two-component developer that includes toner particles and magnetic carrier particles. The exemplary development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Development station 225 can also employ a mono-component developer comprising toner, either magnetic or non-magnetic, without separate magnetic carrier particles.

Transfer subsystem 50 includes transfer backup member 113, and intermediate transfer member 112 for transferring the respective print image from photoreceptor 206 of imaging member 111 through a first transfer nip 201 to surface 216 of intermediate transfer member 112, and thence to a receiver 42 which receives respective toned print images 38 from each printing module in superposition to form a composite image thereon. The print image 38 is, for example, a separation of one color, such as cyan. Receiver 42 is transported by transport web 81. Transfer to a receiver is effected by an electrical field provided to transfer backup member 113 by power source 240, which is controlled by LCU 99. Receiver 42 can be any object or surface onto which toner can be transferred from imaging member 111 by application of the electric field. In this example, receiver 42 is shown prior to entry into a second transfer nip 202, and receiver 42*a* is shown subsequent to transfer of the print image 38 onto receiver 42*a*.

In the illustrated embodiment, the toner image is transferred from the photoreceptor 206 to the intermediate transfer member 112, and from there to the receiver 42. Registration of the separate toner images is achieved by registering the separate toner images on the receiver 42, as is done with the NEXPRESS SX 3900. In some embodiments, a single transfer member is used to sequentially transfer toner images from each color channel to the receiver 42. In other embodiments, the separate toner images can be transferred in register directly from the photoreceptor 206 in the respective printing module 31, 32, 33, 34, 25 to the receiver 42 without using a transfer member. Either transfer process is suitable when practicing this invention. An alternative method of transferring toner images involves transferring the separate toner images, in register, to a transfer member and then transferring the registered image to a receiver.

LCU 99 sends control signals to the charging subsystem 210, the exposure subsystem 220, and the respective development station 225 of each printing module 31, 32, 33, 34, 35 (FIG. 1), among other components. Each printing module can also have its own respective controller (not shown) coupled to LCU 99.

Figure 3:
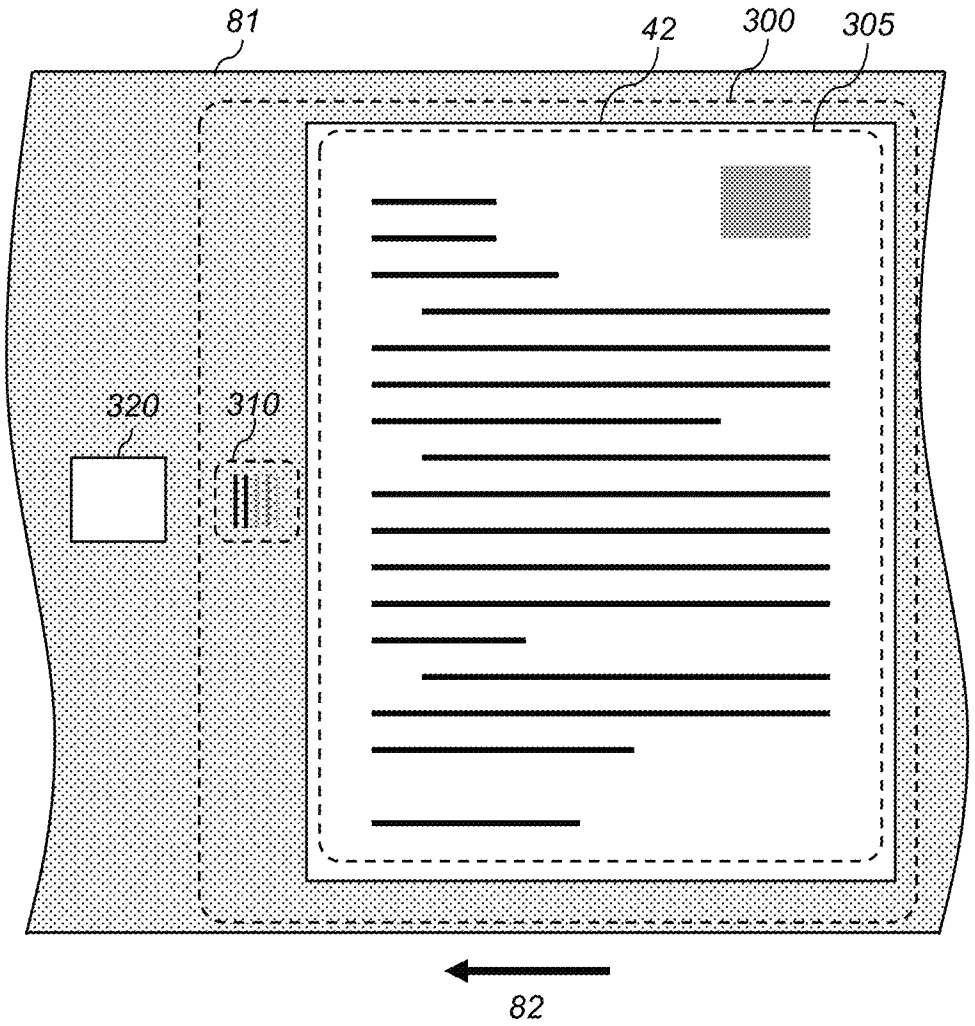
FIG. 3 (Prior Art)
FIG. 3 shows a prior art configuration for characterizing registration errors in an electrophotographic printing system.

In a color printing system, it is important to accurately register the printed image data in the different color channels with each other. An exemplary configuration for characterizing in-track registration errors is illustrated in FIG. 3. As discussed earlier relative to FIG. 1, a piece of receiver 42 is transported on a transport web 81 in an in-track direction 82 past a series of printing modules 31, 32, 33, 34, 35 which print respective toner patterns 300. In the illustrated embodiment, the toner patterns 300 include toner images 305 which are printed onto the receiver 42 in accordance with image data supplied to the exposure subsystem 220 (FIG. 2), together with registration marks 310 which are printed onto the transport web 81 outside the border of the receiver 42. The registration marks 310 are positioned such that they are aligned with the registration mark sensing system 320, which is located along the web transport path downstream of the printing modules 31, 32, 33, 34, 35 (see FIG. 1).

The registration marks 310 include features such as bars or lines or reticules printed by each of the printing modules 31, 32, 33, 34, 35. The registration mark sensing system 320 measures the positions of each of these features and determines registration errors by comparing the measured positions to expected positions. The determined registration errors are then used to adjust the registration of subsequently printed images. In an exemplary embodiment, the in-track component of the registration errors is corrected by adjusting the timing at which the image data is written onto the photoreceptor 206 by the exposure subsystem 220 (FIG. 2).

Figure 4:
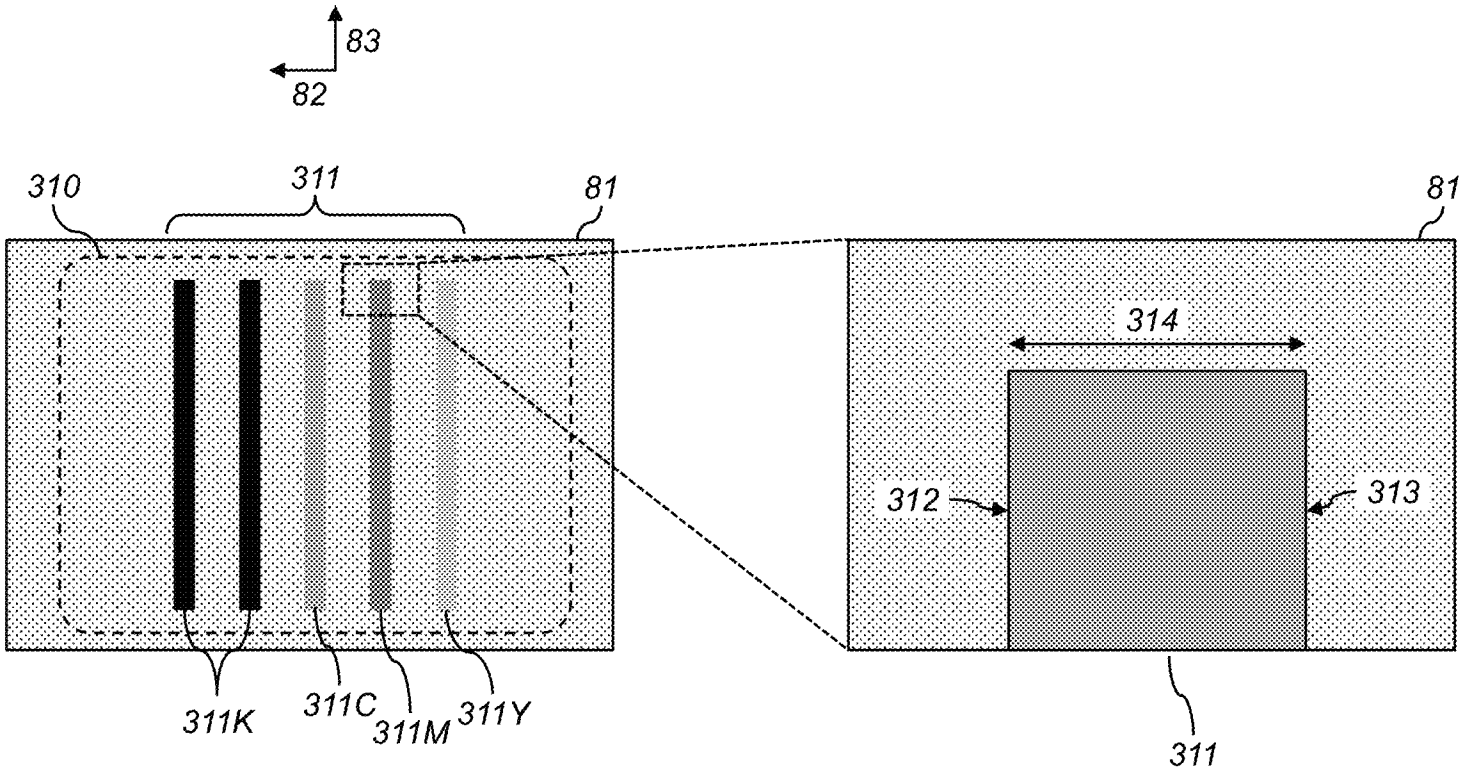
FIG. 4 (Prior Art)
FIG. 4 shows an exemplary registration mark configuration.

FIG. 4 shows additional details of the registration marks 310 in accordance with an exemplary configuration similar to that described in commonly-assigned U.S. Pat. No. 6,493,012 to Buch et al., entitled "Method and apparatus for setting register on a multicolor printing machine by time independent allocation of positions of image productions to printing substrates," which is incorporated herein by reference. The registration marks 310 are printed onto the transport web 31, which is typically a transparent plastic material. The registration marks 310 include a set of bars 311 extending in the cross-track direction 83 that are printed using each of the printing modules 31, 32, 33, 34, 35. Such bars 311 are useful for characterizing in-track, color-to-color registration errors. In the illustrated embodiment, the registration marks 310 include 2 black bars 311K printed by a black printing module, a cyan bar 311C printed by a cyan printing module, a magenta bar 311M printed by a magenta printing module, and a yellow bar 311Y printed by a yellow printing module. In an exemplary configuration, the bars 311 have a length of about 10 mm in the cross-track direction 83 and a bar width 314 (between a first bar edge 312 and a second bar edge 313) of about 0.5 mm in the in-track direction 82.

Figure 5:
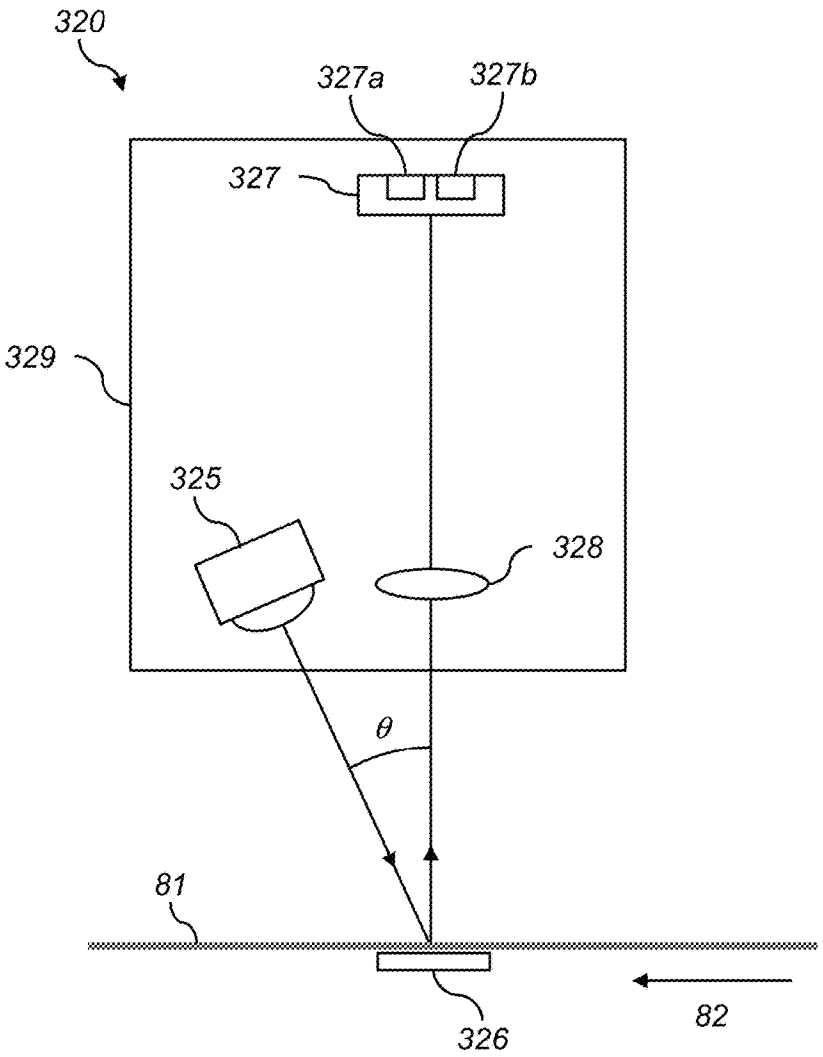
FIG. 5 (Prior Art)
FIG. 5 illustrates an exemplary registration mark sensing system.

FIG. 5 illustrates a configuration for a registration mark sensing system 320 that can be used to measure the positions of the registration marks 310 such as those shown in FIG. 4. The registration mark sensing system 320 includes a light source 325 which directs light onto a top surface of the transport web 81 at an angle θ, which is about 22° in an exemplary configuration. The light source 325 can be an LED light source, or any other appropriate type of source. Preferably, the light source 325 should have a broad spectrum in order to provide adequate signals when sensing different color toners. A reflector plate 326, which conventionally has a white surface is positioned behind the transport web 81, reflects light back toward a light detector 327. A lens 328 is preferably used to focus an image of the registration marks 310 (FIG. 4) on the surface of the transport web 81 onto the light detector 327. In an exemplary embodiment, the light detector 327 includes two sensors 327*a*, 327*b* positioned adjacent to each other in the in-track direction 82 such that a difference between the signals from the two sensors 327*a*, 327*b* provides a differential edge detection signal. In an exemplary configuration, the light source, 325, the light detector 327 and the lens 328 are mounted into a sensing system body 329. While the reflector plate 326 is preferably white, it can have a variety of colors as long as it provides adequate contrast for the set of toner colors being measured. For example, the reflector plate 326 can have a color which is substantially lighter than various colored toners.

Figure 6:
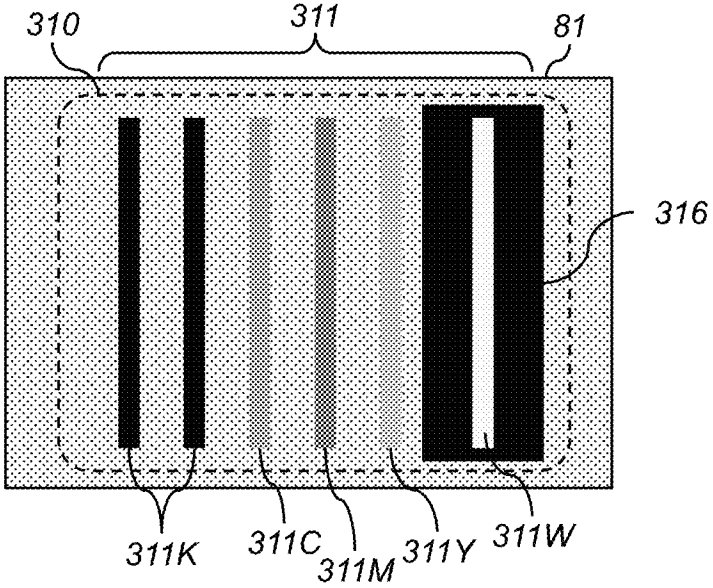
FIG. 6 (Prior Art)
FIG. 6 shows an exemplary registration mark configuration including a bar for a white toner printed on a black background patch.

Detection of strongly pigmented toners such as black, yellow, magenta, and cyan is straightforward using the approach described with respect to FIGS. 4 and 5. However, other non-pigmented or weakly-pigmented toners such as clear, white or metallic, do not provide a strong signal for detection in this arrangement. Within the context of the present disclosure, a non-pigmented toner is a toner that contains no colored pigments to color the toner (e.g., clear, white or metallic toners), and a weakly-pigmented toner is a toner that has a low pigment load such that it cannot be characterized with an adequate detection signal when measured against a white reflector plate 326. (Note that black or gray pigments are considered to be "colored pigments.") As used herein, the term "white" includes a range of colors having values in the well-known CIELAB color space with $L^*80$ and $C^* \leq 15$. White toners may include substances (e.g., titanium dioxide) that some people may refer to as "white pigments," however, within the context of the present disclosure, such toners are still considered to be "non-pigmented toners" since they do not contain colored pigments. This problem is particularly significant for printing systems that utilize a substantially transparent transport web 81. As discussed in commonly-assigned U.S. Pat. No. 8,405,879 to Boness et al., entitled "Method for calibrating a multi-color printing machine," which is incorporated herein by reference, one approach to determining the registration characteristics of such toners is to print the corresponding registration marks over the top of a darker background patch to provide a higher contrast level. FIG. 6 illustrates a configuration of this type in which a registration bar 311W for a white toner is printed over the top of a black background patch 316 printed with the black toner. The signal transition from the black background patch 316 to the white bar 311W provides a much stronger signal than a transition from the transparent transport web 81 to the white bar 311W, thereby enabling accurate determination of the registration characteristics of the white color channel.

Figure 7:
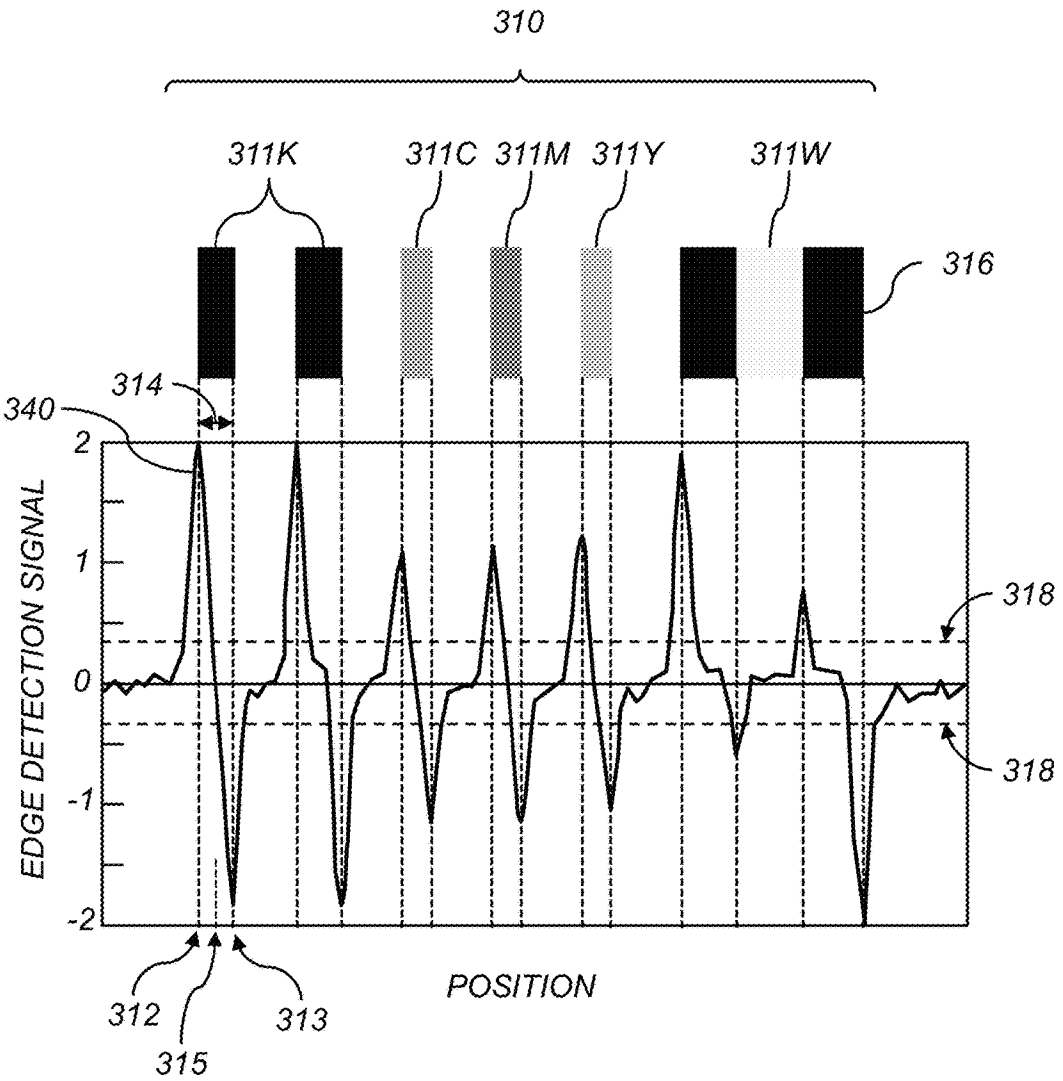
FIG. 7 (Prior Art)
FIG. 7 is an exemplary differential edge detection signal measured for the registration mark configuration of FIG. 6.

FIG. 7 illustrates an exemplary detector signal 340 measured for registration marks 310 similar to those shown in FIG. 6. The detector signal 340 in this example is a differential edge detection signal formed by determining a difference between the detected signals from the sensors 327*a*, 327*b* (FIG. 5). A positive edge detection signal will result when the light detector 327 is aligned with a bar edge such that the first sensor 327*a* senses a high signal level (e.g., corresponding to the transparent transport web 81) and the second sensor 327*b* senses a low signal level (e.g., corresponding to a black bar 311K). Likewise, a negative edge detection signal will result when the light detector 327 is aligned with a bar edge such that the first sensor 327*a* senses a low signal level (e.g., corresponding to a black bar 311K) and the second sensor 327*b* senses a high signal level (e.g., corresponding to the transparent transport web 81). It can be seen that strong edge signals are detected at the edges of each of the registration marks, including the white bar 311W. This enables accurate determination of the locations of the first bar edge 312 and the second bar edge 313.

To determine the locations of the bar edges 312, 313, thresholds 318 can be defined corresponding to a defined percentage (e.g., 25%) of the peak edge detection for the first black bar 311K. The regions having edge detection signals that exceed this threshold (in both the positive and negative directions) are then identified, and the positions of first and second bar edges 312, 313 are determined by finding the local maxima (or minima) of the edge detection signal within each region. A bar position 315 for each of the color channels can be determined by finding the midpoint between the first bar edge 312 and the second bar edge 313.

The approach described in FIGS. 6 and 7 works well if the laydown order of colors is such that the black toner (or another dark toner) is printed before the white toner (or other non-pigmented or weakly-pigmented toner). However, in many usage scenarios it is desirable to print the white toner before the other colored toners. For example, when printing on a colored paper the white toner can be used to provide a white underlayer below the colored toners which greatly improves the image quality. However, this scenario does not allow for the printing of a white registration mark on top of a black underlayer.

Figure 8:
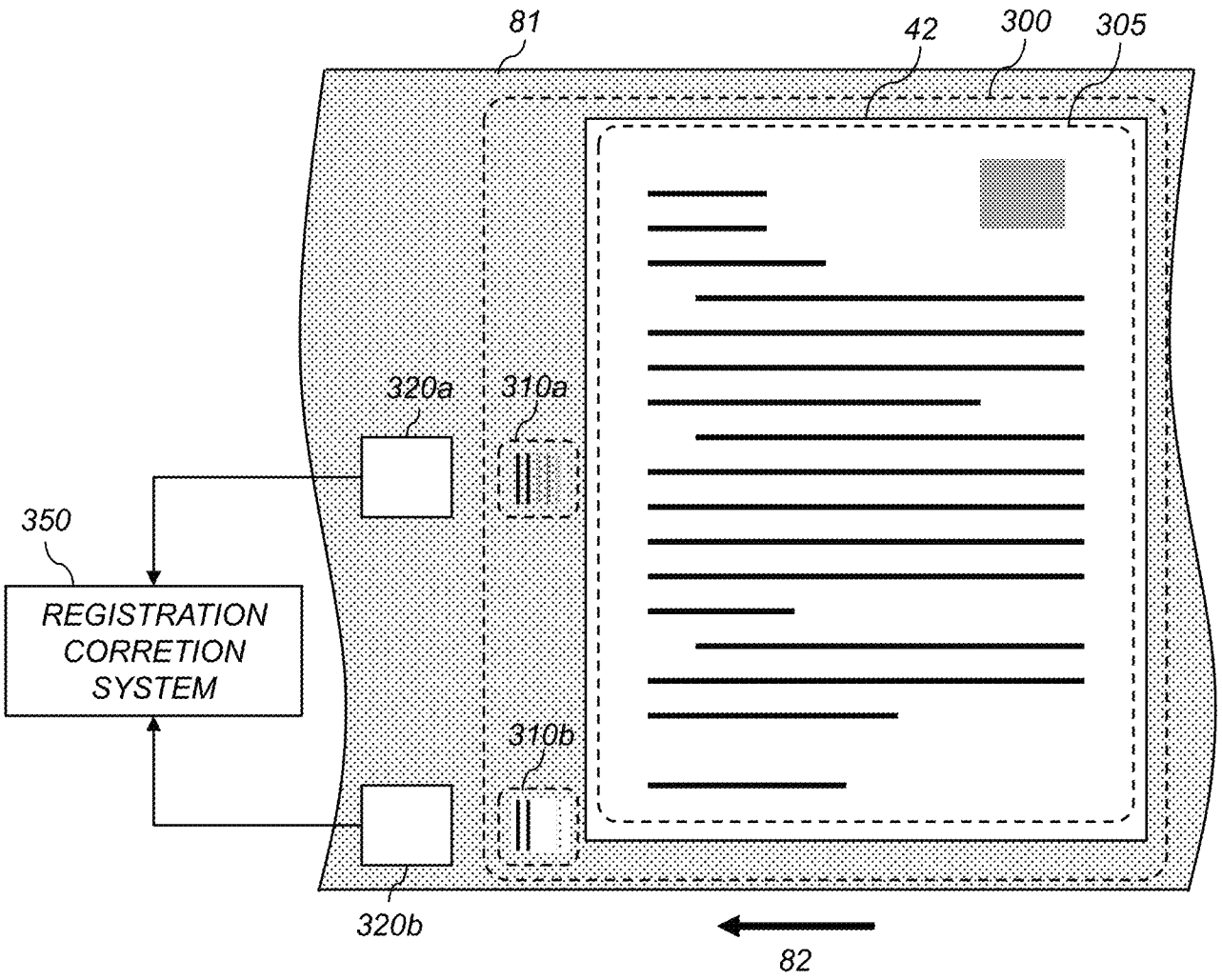
FIG. 8 illustrates a configuration for characterizing registration errors in an electrophotographic printing system in accordance with an exemplary embodiment of the present invention.

FIG. 8 illustrates a configuration which enables the accurate determination of the registration characteristics of white toner (or other non-pigmented or weakly-pigmented toners), even when the white toner or a non-pigmented or weakly-pigmented toner is printed first. The configuration is similar to that described above relative to FIG. 3, except that two sets of registration marks 310*a*, 310*b* are provided at two different cross-track positions and approximately the same in-track position. The first set of registration marks 310*a* is aligned with a first registration mark sensing system 320*a*, and the second set of registration marks 310*b* is aligned with a second registration mark sensing system 320*b*. In the illustrated configuration, the first set of registration marks 310*a* are printed near the center of the transport web 81 and the second set of registration marks 310*b* are positioned toward one edge of the transport web 81. In an exemplary embodiment, the first registration mark sensing system 320*a* is of the type described relative to FIG. 5, where the reflector plate 326 has a white surface. This is used to provide registration information for the highly-pigmented toner colors. The second registration mark sensing system 320*b* is similar to the first registration mark sensing system 320*a* except that the reflector plate 326 has a black surface. Alternatively, the reflector plate 326 can have some other color as long as it provides adequate contrast with the white toner (or the other non-pigmented or weakly-pigmented toner). For example, the reflector plate 326 can be dark gray or some other color which is substantially darker than the white toner. In other embodiments, the two sets of registration marks 310*a*, 310*b* can be positioned in locations other than those shown in FIG. 8. For example, they can be positioned along opposite edges of the transport web 81. Alternately they could be positioned at different in-track positions and the same cross-track position. In this case, the registration mark sensing systems 320*a*, 320*b* would also need to be positioned at different in-track positions.

Figure 9B:
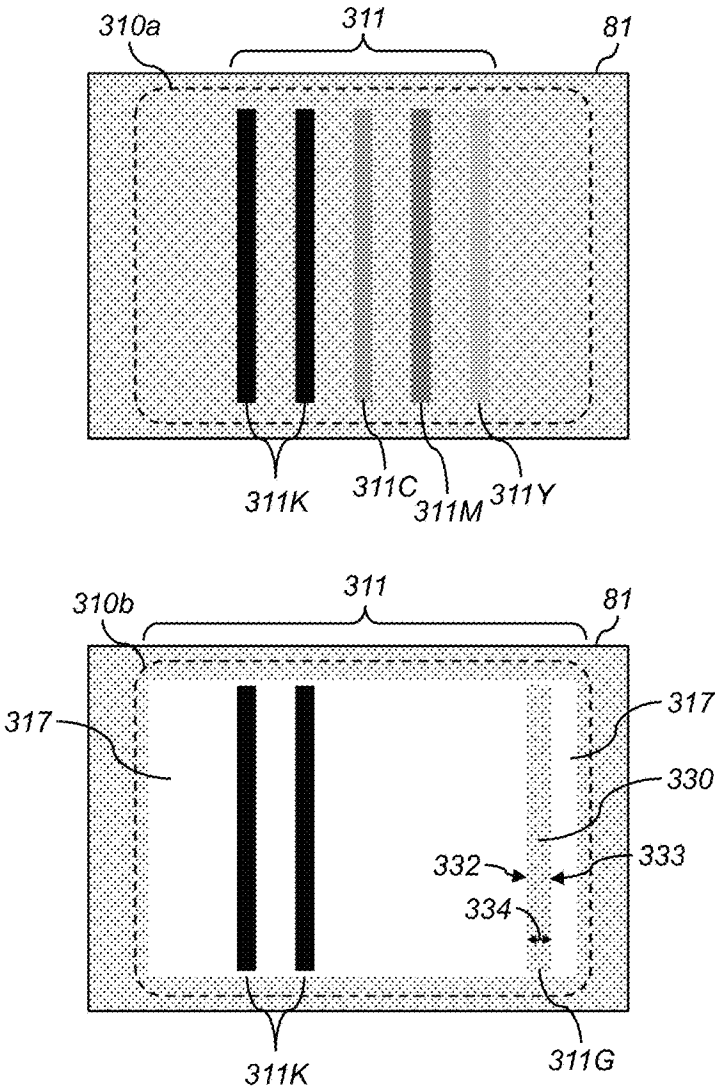
FIGS. 9A-9C shows exemplary registration mark patterns that can be used with the embodiment of FIG. 8.
Figure 9A:
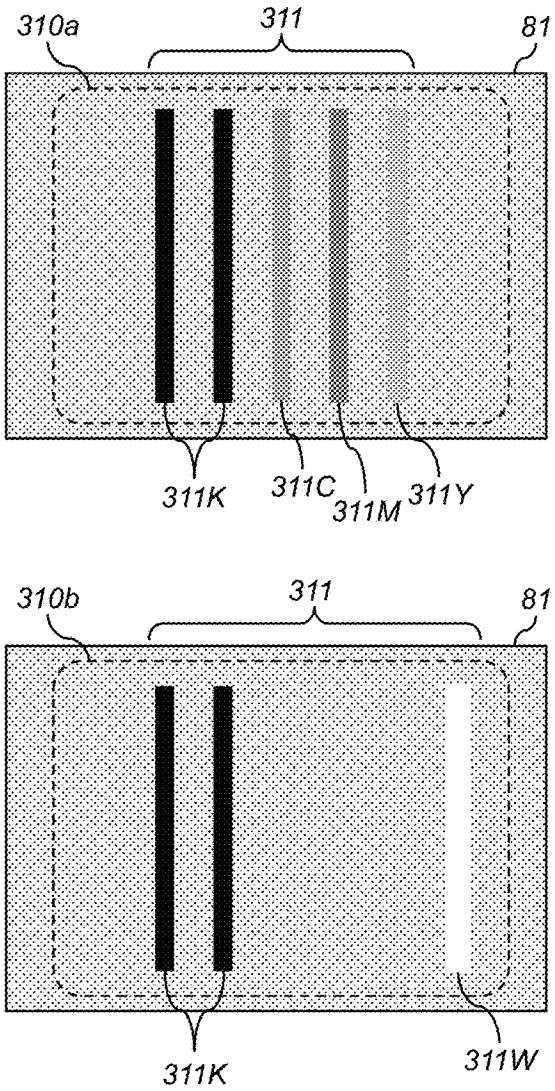

FIG. 9A illustrates an exemplary configuration of registration marks 310*a*, 310*b* that can be used in accordance with the embodiment of FIG. 8. In this example, the first set of registration marks 310*a* are similar to those shown in FIG. 4 and include two black bars 311K, a cyan bar 311C, a magenta bar 311M and a yellow bar 311Y. The second set of registration marks 310*b* include a white bar 311W, as well as one or more bars printed with other channels such as black bars 311K which act as a reference from which the relative position of the white bar 311W can be determined. The white bar 311W will have a good contrast relative to the color of the transport web 81 when backed by the dark reflector plate 326. However, depending on the color of the reflector plate 326 in the second registration mark sensing system 320*b*, the black bars may not have a strong contrast with relative to the color of the reflector plate 326.

Figure 9C:
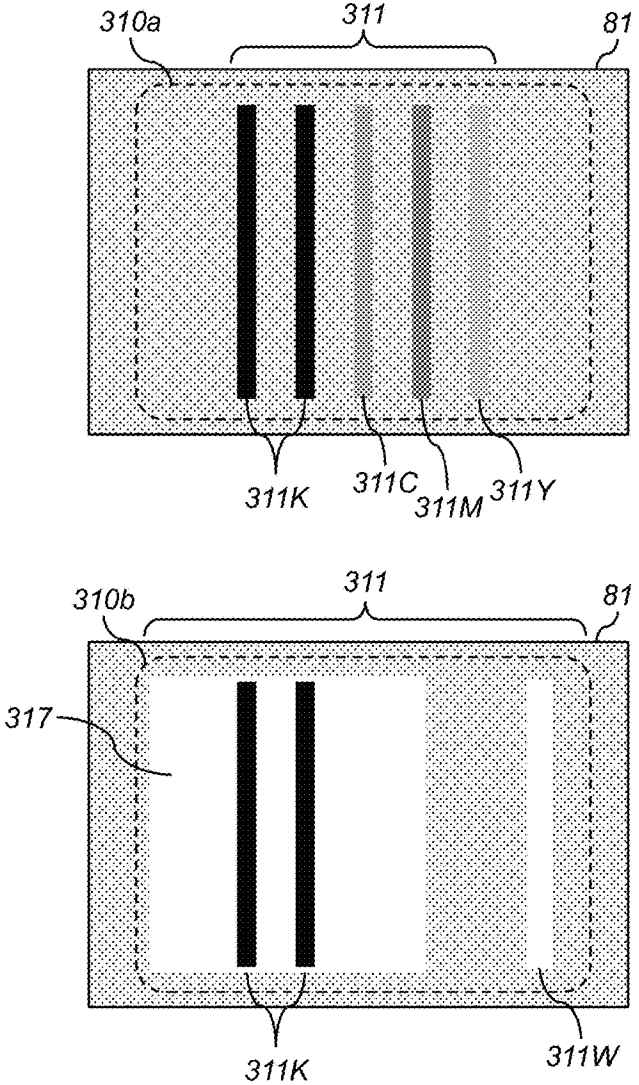

The exemplary configuration shown in FIG. 9B addresses this potential problem by printing the black bars 311K over the top of a white background patch 317 printed with the white toner. In this configuration the "registration mark" for sensing the position of the white toner is a gap 330 in the background patch 317. The gap 330 has a first gap edge 332 and a second gap edge 333 to form a "gap bar" 311G with a gap width 334. The background patch 317 with the corresponding gap 330 therefore serves as the registration mark for the white color channel. In other embodiments, the white background patch 317 is only printed behind the black bars 311K and a white bar 311W (similar to that in FIG. 9A) is also provided as illustrated in FIG. 9C. A desirable attribute of the FIG. 9B configuration is that the edge detection signal (i.e., detector signal 340 of FIG. 7) will have a positive value or signal for the first edge and a negative value or signal for the second edge for both the black bars 311K and the gap bar 311G. In the FIG. 9C configuration, the edge detection signal for the white bar 311W will have the opposite polarity requiring that the signal analysis method be adjusted accordingly.

In some embodiments, registration marks for other color channels can also be included in the second set of registration marks 310*b*. For example, the yellow toner may have a better contrast against the black reflector plate 326 of the second registration mark sensing system 320*b* than against the white reflector plate 326 of the first registration mark sensing system 320*a*. It can therefore be advantageous to include the yellow bar 311Y in the second set of registration marks 310*b* rather than the first set of registration marks 310*a*.

The method of the present invention can also be applied to other non-pigmented or weakly-pigmented toners besides white toners. For example, clear toners will have a diffuse scattering characteristic before they go through the fuser module 60 so that they will be more easily detectable against the black reflector plate 326 of the second registration mark sensing system 320*b* than against the white reflector plate 326 of the first registration mark sensing system 320*a*. Likewise, various other types of toners such as metallic toners may have a better contrast when measured with the second registration mark sensing system 320*b*.

In accordance with any of the disclosed embodiments, a registration correction system 350 uses the signals collected from the registration mark sensing systems 320*a*, 320*b* to make appropriate corrections to the registration of subsequently printed images. The registration mark sensing system 350 can be implemented using any appropriate data processing system such as the logic and control unit 99 to perform various analysis and provide various control signals.

Figure 10:
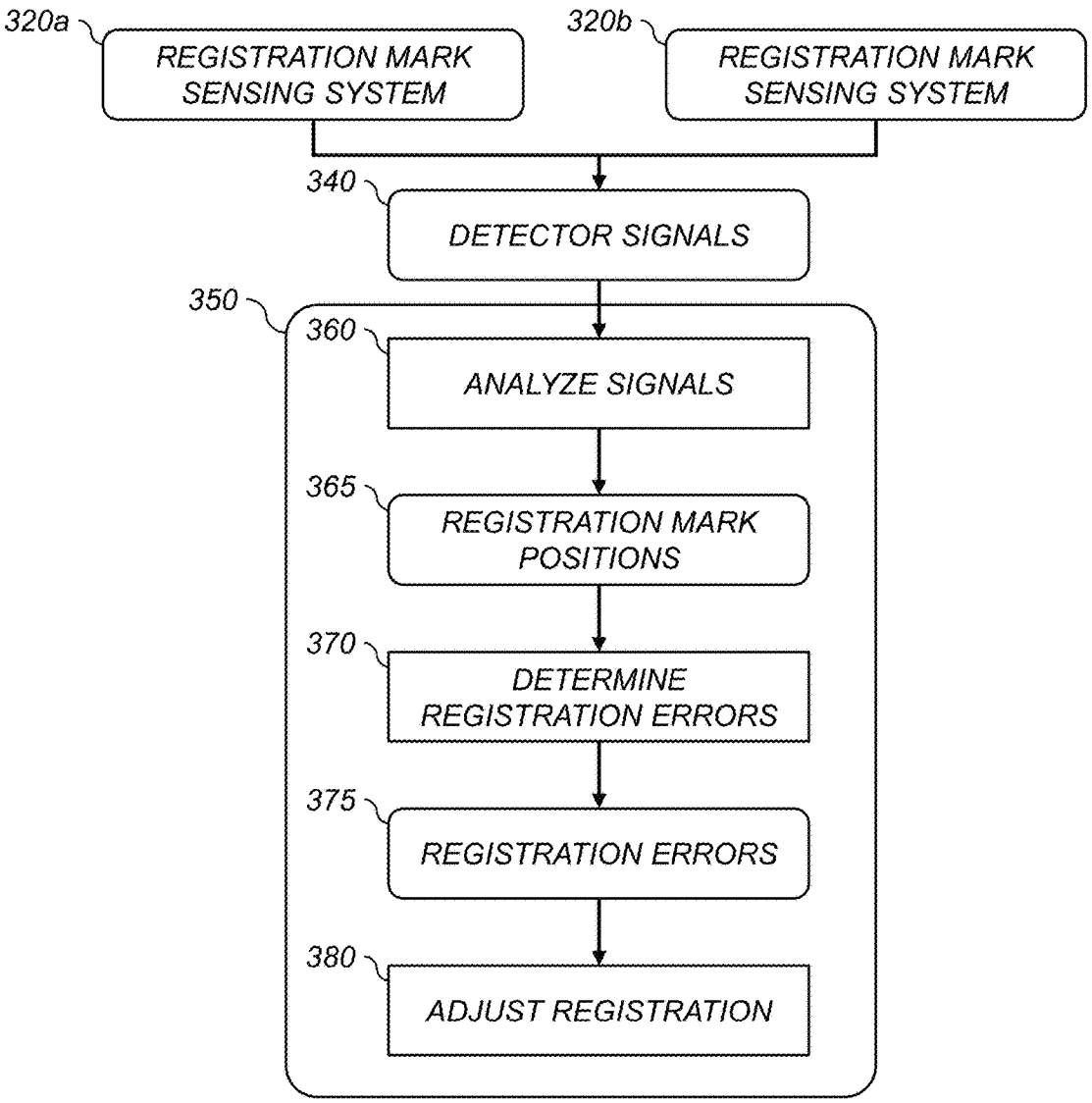
FIG. 10 shows a flowchart of a registration correction process in accordance with an exemplary embodiment of the present invention.

FIG. 10 shows a flowchart of a registration correction process applied by the registration mark sensing system 350 in an exemplary embodiment. An analyze signals step 360 analyzes the detector signals 340 from the registration mark sensing systems 320*a*, 320*b* to detect registration mark positions 365 of the registration marks 310 printed by each of the printing modules 31, 32, 33, 34, 35. In an exemplary configuration, one of the color channels (e.g., the black color channel) is designated to be a reference color channel, and the positions of the other registration marks (e.g., bars 311C, 311M, 311Y, 311W, 311G) are determined relative to the position of the reference registration marks (e.g., bars 311K). The positions of the registration marks 310 (e.g., the bar positions 315) are then compared to expected positions to determine corresponding registration errors 375 using a determine registration errors step 370. The registration characteristics of subsequently printed toner patterns 300 are then adjusted to compensate for the determined registration errors using an adjust registration step 380. For example, an in-track registration error for a particular color channel can be corrected by adjusting the start time at which the exposure subsystem 220 in the corresponding printing module starts printing the image data onto the photoreceptor 206 to delay or advance the position of the toner pattern 300 on the receiver 42 and transport web 81.

In alternate embodiments, rather than providing two separate registration mark sensing systems 320*a*, 320*b* having different reflector plates 326, a means for changing the color of the backing behind the transport web 81 can be provided with a single registration mark sensing system 320. For example, a shutter system can be provided which can be opened or closed according to the color of the bar being measured. When the shutter is open it exposes a reflector plate having one color, and when it is closed the top surface of the shutter serves as a reflector plate having a second color. The shutter could be mechanical (e.g., utilizing a translational or rotational motion) or electro-optical (e.g., operating by re-orientation of a material based on an electrical switch). Such embodiments require the capability of rapidly switching between the two states as the different bars pass by the registration mark sensing system 320.

Figure 11:
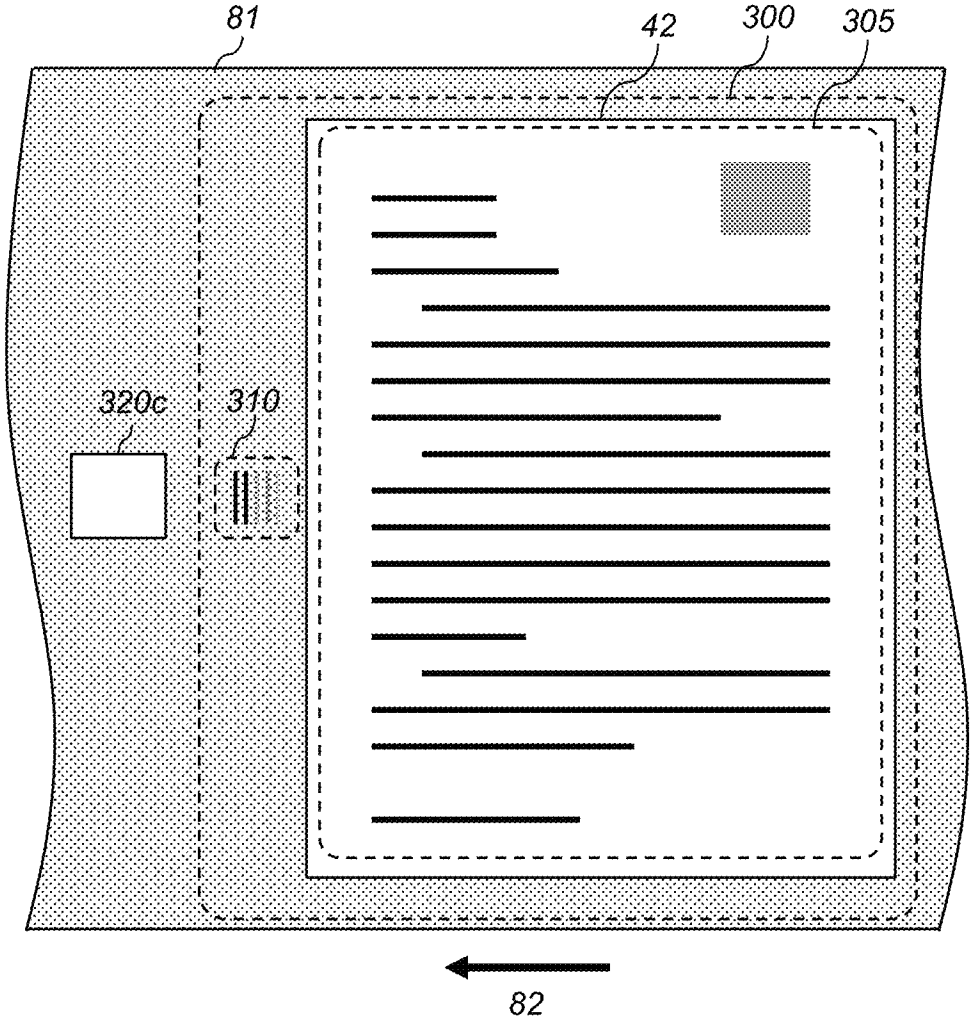
FIG. 11 illustrates a configuration for characterizing registration errors in an electrophotographic printing system in accordance with an alternate embodiment.

In another embodiment, rather than using two different registration mark sensing systems 320*a*, 320*b* having white and black reflector plates 326 (FIG. 5) as described relative to FIG. 8, a single registration mark sensing system 320*c* can be used as shown in FIG. 11. However, rather than using a white reflector plate 326 as in the prior art registration mark sensing system 320 of FIG. 3, the registration mark sensing system 320*c* uses a colored reflector plate 326, where the color is selected to provide an adequate detection signal for all of the different toners, pigmented or non-pigmented, used in the printer 100 (FIG. 1). Within the context of the present disclosure, the reflector plate 326 is said to be "colored" if it is not white. In some embodiments the colored reflector plate 326 can have a non-neutral color (e.g., having a chroma value of $C^* \geq 10$). In other embodiments, the colored reflector plate 326 can have a black color, or can be a gray color, provided that it provides an adequate detection signal for all of the different toners.

To accomplish this, the color of the colored reflector plate 326 should preferably have a color which is significantly different than the colors of each of the toners used in the printing modules 31, 32, 33, 34, 35 of the printer 100. The sensor signals $d_m$ for the registration marks can be determined by integrating the product of the spectral sensitivity $S(\lambda)$ of the registration mark sensing system 320 and the reflection spectra $R_m(\lambda)$ of the printed registration marks 310 on the transport web 81 when positioned over the color reflector plate 326:

$$d_m = \int S(\lambda) R_m(\lambda) d\lambda \tag{1}$$

The sensor signal $d_w$ for the bare transport web 81 can similarly be determined from the reflection spectrum $R_w(\lambda)$ of the transport web 81 when positioned over the color reflector plate 326:

$$d_w = \int S(\lambda) R_w(\lambda) d\lambda \tag{2}$$

The difference between the sensor signals for the registration mark and the bare transport web defines a detection signal $D_m$:

$$D_m = |d_w - d_m| \tag{3}$$

In an exemplary configuration, the color of the colored reflector plate 326 is selected so that the detection signal for the registration marks printed with each of the different toner colors exceeds a predefined threshold. Preferably, the threshold is defined as a fraction of the sensor signal for the bare transport web:

$$D_m \geq T_d d_w \tag{4}$$

where $T_d$ is a predefined fraction. In an exemplary embodiment, a threshold of $T_d = 0.25$ is used. The selection of the color of the colored reflection plate can be an iterative process where various reflection plate colors are evaluated until one is found which provides an adequate detection signal for each of the different toner colors.

In one exemplary embodiment, the colored reflection plate 326 has a gray color with an L* value selected to be intermediate to the L* values of each of the toners. For example, a large L* gap is typically found between the L* of white and yellow toners and the L* of the cyan and red toners. A colored reflection plate 326 having a gray color with an L* that is approximately in the middle of this L* gap can provide adequate detection signals in some configurations. In other embodiments, a colored reflection plate 326 having a gray color with an L* that is intermediate to the L* of the magenta and blue toners can provide adequate detection signals.

The invention has been described in detail with particular reference to certain preferred embodiments thereof, but it will be understood that variations, combinations, and modifications can be effected by a person of ordinary skill in the art within the spirit and scope of the invention.

PARTS LIST

31 printing module
32 printing module
33 printing module
34 printing module
35 printing module
38 print image
39 fused image

40 supply unit
42 receiver
42*a* receiver
42*b* receiver
50 transfer subsystem
60 fuser module
62 fusing roller
64 pressure roller
66 fusing nip
68 release fluid application substation
69 output tray
70 finisher
81 transport web
82 in-track direction
83 cross-track direction
85 leading edge sensor
86 cleaning station
99 logic and control unit
100 printer
111 imaging member
112 intermediate transfer member
113 transfer backup member
201 first transfer nip
202 second transfer nip
206 photoreceptor
210 charging subsystem
211 meter
212 meter
213 grid
216 surface
220 exposure subsystem
225 development subsystem
226 toning shell
227 magnetic core
240 power source
300 toner pattern
305 toner image
310 registration marks
310*a* registration marks
310*b* registration marks
311 bar
311C bar
311G bar
311K bar
311M bar
311W bar
311Y bar
312 first bar edge
313 second bar edge
314 bar width
315 bar position
316 black background patch
317 white background patch
318 threshold
320 registration mark sensing system
320*a* registration mark sensing system
320*b* registration mark sensing system
320*c* registration mark sensing system
325 light source
326 reflector plate
327 light detector
327*a* sensor
327*b* sensor
328 lens
329 sensing system body
330 gap
332 first gap edge
333 second gap edge
334 gap width
340 detector signal
350 registration correction system
360 analyze signals step
365 registration mark positions
370 determine registration errors step
375 registration errors
380 adjust registration step

The invention claimed is:

1. An electrophotographic printing system for printing with a set of toners including a white toner, comprising:

(a) a transport web that is at least partially transparent, wherein the transport web moves in an in-track direction;

(b) a plurality of printing modules, each printing module configured to print a toner pattern using a respective toner from the set of toners onto a first surface of the transport web, wherein the toner pattern includes a toner image to be printed onto a receiver medium being transported on the first surface of the transport web and a corresponding registration mark positioned outside a border of the receiver medium;

(c) a first registration mark sensing system positioned to detect the registration marks printed with a first subset of the toners that doesn't include the white toner, the first registration mark sensing system including:

(i) a first light source positioned over the first surface of the transport web;

(ii) a first reflector plate positioned behind the transport web, wherein the first reflector plate has a color which is lighter than the toners in the first subset of toners; and (iii) a first light detector positioned over the first surface of the transport web;

wherein the first light detector is positioned to detect light that is emitted by the first light source, transmitted through the transport web and reflected off the first reflector plate;

(d) a second registration mark sensing system positioned to detect the registration marks printed with a second subset of the toners that includes the white toner, the second registration mark sensing system including:

(i) a second light source positioned over the first surface of the transport web;

(ii) a second reflector plate positioned behind the transport web, wherein the second reflector plate has a color which is darker than the white toner; and (iii) a second light detector positioned over the first surface of the transport web;

wherein the second light detector is positioned to detect light that is emitted by the second light source, transmitted through the transport web and reflected off the second reflector plate; and (e) a registration correction system that analyzes signals from the first and second registration mark sensing systems to detect positions of the registration marks printed by each of the printing modules, determines corresponding registration errors, and adjusts the registration of subsequently printed toner patterns to compensate for the determined registration errors.

2. The electrophotographic printing system of claim 1, wherein the registration marks printed using the first subset of toners include bars, each having a first bar edge and a second bar edge separated by a bar width in the in-track direction, and wherein the detection of the positions of the registration marks includes detecting bar positions by detecting light-to-dark transitions corresponding to the first bar edges of the bars and dark-to-light transitions corresponding to the second bar edges of the bars.

3. The electrophotographic printing system of claim 2, wherein one of the toners in the first subset of toners is designated to be a reference toner and the other toners in the first subset of toners are designated to be non-reference toners, and wherein the registration errors for the non-reference toners are determined by comparing differences between the detected bar position of the reference toner and the detected bar positions of the non-reference toners to expected differences.

4. The electrophotographic printing system of claim 1, wherein the registration marks printed using the second subset of toners include one or more bars, each having a first bar edge and a second bar edge separated by a bar width in the in-track direction, and wherein the detection of the positions of the registration marks includes detecting bar positions for at least some of the bars by detecting dark-to-light transitions corresponding to the first bar edges of the bars and light-to-dark transitions corresponding to the second bar edges of the one or more bars.

5. The electrophotographic printing system of claim 1, wherein the registration marks printed using the second subset of toners include a white patch printed with the white toner, the white patch including a gap having a first gap edge and a second gap edge separated by a gap width in the in-track direction, and wherein the detection of the positions of the registration mark for the white toner includes detecting a gap position by detecting a light-to-dark transition corresponding to the first gap edge of the gap and a dark-to-light transition corresponding to the second gap edge of the gap.

6. The electrophotographic printing system of claim 5, wherein the registration marks printed using the second subset of toners includes a bar printed with a toner having a color other than white, the bar being printed over the top of the white patch and having a first bar edge and a second bar edge separated by a bar width in the in-track direction, and wherein the detection of the positions of the registration marks includes detecting a bar position for the bar by detecting a light-to-dark transitions corresponding to the first bar edge and a dark-to-light transition corresponding to the second bar edge.

7. The electrophotographic printing system of claim 6, wherein the toner having a color other than white is designated to be a reference toner, and wherein the bar registration error for the white toner is determined by comparing a difference between the detected gap position and the detected bar position to an expected difference.

8. The electrophotographic printing system of claim 7, wherein the reference toner is also included in the first subset of toners, the other toners in the first subset of toners being designated to be non-reference toners, and wherein the registration errors for the non-reference toners are determined by comparing differences between a detected bar position for a bar printed using the reference toner and detected bar positions for bars printed using the non-reference toners to expected differences.

9. The electrophotographic printing system of claim 1, wherein the registration marks printed with the first subset of toners are printed at a first cross-track position and the registration marks printed with the second subset of toners are printed at a second cross-track position, and wherein the first registration mark sensing system is positioned to detect registration marks at the first cross-track position and the second registration mark sensing system is positioned to detect registration marks at the second cross-track position.

10. The electrophotographic printing system of claim 1, further including a fusing module which fuses the printed toner images onto the receiver medium, and a cleaning station which cleans the printed registration marks off the surface of the transport web.

11. The electrophotographic printing system of claim 1, wherein the first subset of toners includes a cyan toner, a magenta toner, a yellow toner or a black toner.

12. The electrophotographic printing system of claim 1, wherein the first reflector plate has a white color and the second reflector plate has a black color.

13. The electrophotographic printing system of claim 1, wherein the determined registration errors are in-track registration errors.

14. The electrophotographic printing system of claim 1, wherein the white toner is printed before the other toners in the set of toners.

15. The electrophotographic printing system of claim 1, wherein adjusting the registration of subsequently printed toner patterns includes adjusting start times for printing the toner patterns responsive to the determined registration errors.

16. An electrophotographic printing system for printing with a set of toners including a non-pigmented toner, comprising:

(a) a transport web that is at least partially transparent, wherein the transport web moves in an in-track direction;

(b) a plurality of printing modules, each printing module configured to print a toner pattern using a respective toner from the set of toners onto a first surface of the transport web, wherein the toner pattern includes a toner image to be printed onto a receiver medium being transported on the first surface of the transport web and a corresponding registration mark positioned outside a border of the receiver medium;

(c) a first registration mark sensing system positioned to detect the registration marks printed with a first subset of the toners that doesn't include the non-pigmented toner, the first registration mark sensing system including:

(i) a first light source positioned over the first surface of the transport web;

(ii) a first reflector plate positioned behind the transport web, wherein the first reflector plate has a color which is lighter than the toners in the first subset of toners; and (iii) a first light detector positioned over the first surface of the transport web;

wherein the first light detector is positioned to detect light that is emitted by the first light source, transmitted through the transport web and reflected off the first reflector plate;

(d) a second registration mark sensing system positioned to detect the registration marks printed with a second subset of the toners that includes the non-pigmented toner, the second registration mark sensing system including:

(i) a second light source positioned over the first surface of the transport web;

(ii) a second reflector plate positioned behind the transport web, wherein the second reflector plate has a color which is darker than the non-pigmented toner; and (iii) a second light detector positioned over the first surface of the transport web;

wherein the second light detector is positioned to detect light that is emitted by the second light source, transmitted through the transport web and reflected off the second reflector plate; and (e) a registration correction system that analyzes signals from the first and second registration mark sensing systems to detect positions of the registration marks printed by each of the printing modules, determines corresponding registration errors, and adjusts the registration of subsequently printed toner patterns to compensate for the determined registration errors.

17. The electrophotographic printing system of claim 16, wherein the non-pigmented toner is a white toner, a clear toner, or a metallic toner.

* * * * *